US008118195B2

(12) United States Patent
Decottignies

(10) Patent No.: US 8,118,195 B2
(45) Date of Patent: Feb. 21, 2012

(54) FLUID PRODUCT DISPENSING MEMBER AND DISPENSER COMPRISING SAME

(75) Inventor: Laurent Decottignies, Cergy (FR)

(73) Assignee: Airlessystems, Charleval (FR)

( * ) Notice: Subject to any disclaimer, the term of this patent is extended or adjusted under 35 U.S.C. 154(b) by 487 days.

(21) Appl. No.: 12/160,173

(22) PCT Filed: May 3, 2007

(86) PCT No.: PCT/FR2007/051206

§ 371 (c)(1),
(2), (4) Date: Oct. 22, 2008

(87) PCT Pub. No.: WO2007/128935

PCT Pub. Date: Nov. 15, 2007

(65) Prior Publication Data

US 2009/0065531 A1 Mar. 12, 2009

(30) Foreign Application Priority Data

May 5, 2006 (FR) ..... 06 51621

(51) Int. Cl.
*B65D 37/00* (2006.01)

(52) U.S. Cl. ..... 222/207; 222/153.01; 222/153.14; 222/256; 222/259; 222/321.9; 222/380; 222/386

(58) Field of Classification Search ..... 222/256, 222/259–260, 207, 380, 321.9, 386, 383.1, 222/384, 383.3, 340, 153.04, 153.01
See application file for complete search history.

(56) References Cited

U.S. PATENT DOCUMENTS

| | | | | |
|---|---|---|---|---|
| 4,485,943 | A * | 12/1984 | Czech | 222/256 |
| 4,685,594 | A * | 8/1987 | Czech | 222/182 |
| 4,771,925 | A * | 9/1988 | Stoffler et al. | 222/207 |
| 4,809,887 | A * | 3/1989 | Jupin et al. | 222/207 |
| 4,838,441 | A * | 6/1989 | Chernack | 215/216 |
| 4,913,322 | A * | 4/1990 | Stoffler et al. | 222/207 |
| 6,240,979 | B1 * | 6/2001 | Lorscheidt | 141/2 |
| 6,854,619 | B2 * | 2/2005 | Knickerbocker | 222/1 |
| 6,968,981 | B2 * | 11/2005 | Heukamp | 222/257 |
| 7,028,865 | B2 * | 4/2006 | Heukamp | 222/207 |
| 7,654,418 | B2 * | 2/2010 | Law et al. | 222/259 |

FOREIGN PATENT DOCUMENTS

| | | |
|---|---|---|
| DE | 202 03 882 U1 | 5/2003 |
| EP | 0 758 615 A1 | 2/1997 |
| EP | 0 974 402 A1 | 1/2000 |
| FR | 2 857 343 A1 | 1/2005 |
| FR | 2 877 325 A1 | 5/2006 |

* cited by examiner

*Primary Examiner* — Frederick C. Nicolas
(74) *Attorney, Agent, or Firm* — Sughrue Mion, PLLC

(57) ABSTRACT

A fluid dispenser member (1) for associating with a fluid reservoir (2) so as to form a fluid dispenser, the member (1) including a body (11) via which the dispenser member is mounted in stationary manner on a mounting part (3), the body (11) defining a housing (113) for receiving another component element (13) of the dispenser member. The housing (113) includes a movable portion (115) that is displaceable from an initial configuration in which the housing is open, to a final configuration in which the housing is closed on the component element (13) while the dispenser member (1) is being mounted in the mounting part (3).

12 Claims, 1 Drawing Sheet

FLUID PRODUCT DISPENSING MEMBER AND DISPENSER COMPRISING SAME

FIELD OF THE INVENTION

The present invention relates to a fluid dispenser member, e.g. of the pump or valve type, for associating with a fluid reservoir, thereby forming a fluid dispenser. In addition, the present invention also relates to such a fluid dispenser. This type of dispenser member and dispenser finds an advantageous, but not exclusive, application in the fields of perfumery, cosmetics, or even pharmacy.

BACKGROUND

There exist numerous types of fluid dispenser member that enable fluid to be dispensed from a fluid reservoir. Amongst such dispenser members, mention can be made, in particular, of pumps and valves that are active members, as opposed to passive dispenser members in the form of simple dispenser orifices that are closable by means of an outlet valve or a stopper. Usually, the dispenser member includes a body via which the dispenser member is mounted in stationary manner on a mounting part of the dispenser, which can be the reservoir proper, or it can be an intermediate element that is mounted on the reservoir and receives the dispenser member. It is also possible to imagine a plurality of intermediate elements connecting the dispenser member to the reservoir. In any event, the body must always be mounted on some form of mounting part. In general, the body serves to support other component elements of the dispenser member. For a pump, the body also serves to support the inlet valve, and, in co-operation with a piston, also defines a pump chamber of variable volume. The pump or dispenser chamber communicates with the reservoir by means of the inlet valve, and advantageously communicates with the outside through an outlet valve.

In entirely conventional manner, mounting the dispenser member on the mounting part merely has the function of holding the dispenser member in firm and leaktight manner, so as to constitute a dispenser that is strong and leaktight.

In other words, mounting the dispenser member on the mounting part does not influence the assembly of the various component elements of the dispenser member. For example, when the body defines a housing for receiving another component element of the dispenser member, fastening or sealing the component element in the housing of the body is not in any way dependent on mounting the dispenser member on the mounting part.

SUMMARY OF CERTAIN OBJECTS OF THE INVENTION

An object of the present invention is to use the operation of mounting the dispenser member on the mounting part to influence the assembly or the co-operation of the various component elements of the dispenser member. Mounting the dispenser member on the mounting part should be capable of improving the fastening and/or the sealing of a component element of the dispenser member on its body.

To achieve this object, the present invention proposes a fluid dispenser member for associating with a fluid reservoir so as to form a fluid dispenser, said member including a body via which the dispenser member is mounted in stationary manner on a mounting part, the body defining a housing for receiving another component element of the dispenser member, the member being characterized in that the housing includes a movable portion that is displaceable from an initial configuration in which the housing is open, to a final configuration in which the housing is closed on the component element while the dispenser member is being mounted in the mounting part. Consequently, before being mounted on the mounting part, the dispenser member is not in its final assembled configuration, which is reached only when said dispenser member is mounted in permanent manner on the mounting part. In other words, the mounting part is used to terminate or complete the assembly of the dispenser member. The mounting part thus serves as constraining or urging means that make it possible to bring the dispenser member into is final assembled configuration. Instead of closing a housing, it is quite possible to imagine that the mounting part urges a portion of the body or a portion of a component element to come into engagement with another component element of the dispenser member. The mounting part thus makes it possible to bring the dispenser member into a final assembled configuration from a non-definitive pre-mounted or pre-assembled configuration.

In an advantageous embodiment, the movable portion of the housing may comprise an outer peripheral collar that is deformable radially inwards against said component element so as to block it firmly in the housing. The collar is advantageously continuous over its periphery. In a variant, the collar is slotted over its periphery. The collar is thus inserted, engaged, or interfitted into the mounting part that surrounds the collar closely and deforms or moves it radially inwards. The mounting part thus acts as a hoop that surrounds the collar closely and urges it inwards.

In an advantageous embodiment, said component element co-operates with the body to form a fluid dispenser chamber. Advantageously, said component element forms an elastically-deformable membrane that is provided with an anchor heel that is engaged in leaktight manner in the housing, the movement of the movable portion compressing the heel in its housing. Before mounting the dispenser member on its mounting part, the heel of the deformable membrane is pre-mounted in the housing, and is held inside said housing in manner that is sufficient to enable the dispenser member to be manipulated, stored, and fitted on its mounting part. Closing the housing by moving the movable portion not only finishes off fastening the heel in the housing, but also guarantees good sealing of the dispenser chamber where the heel meets the body. Any risk of fluid leaking from the pump chamber at this point is thus avoided.

The present invention also provides a fluid dispenser comprising a fluid dispenser member as defined above, and a fluid reservoir. In one possible embodiment the mounting part is the reservoir. In a preferred variant, the mounting part is an adapter dish that is received on the reservoir, the dish including a ring in which the body of the dispenser member is mounted, the movable portion being moved into its final configuration while it is being engaged in the ring. The adapter dish serves as a connection part between the dispenser member and the reservoir. It advantageously makes it possible to mount a standard dispenser member on several versions of reservoir by modifying only the adapter dish. The ring of the dish remains identical, given that the dispenser member is standard. However, the shape, the size, and the configuration of the dish can be modified as a function of the type of reservoir on which the standard dispenser member is to be mounted.

In a preferred embodiment, the reservoir comprises a cylinder and a follower piston that is engaged to slide in the cylinder in sealed manner, and the dispenser member is a so-called airless pump.

BRIEF DESCRIPTION OF THE DRAWINGS

The invention is described more fully below with reference to the accompanying drawing which shows an embodiment of the invention by way of non-limiting example.

In the figures.

DETAILED DESCRIPTION OF EXEMPLARY EMBODIMENTS OF THE INVENTION

In the figures, the dispenser member selected to illustrate the present invention is an airless pump. However, it is possible to use any other type of pump, or any other type of dispenser member, e.g. a valve, without thereby going beyond the ambit of the present invention.

Figure 1:
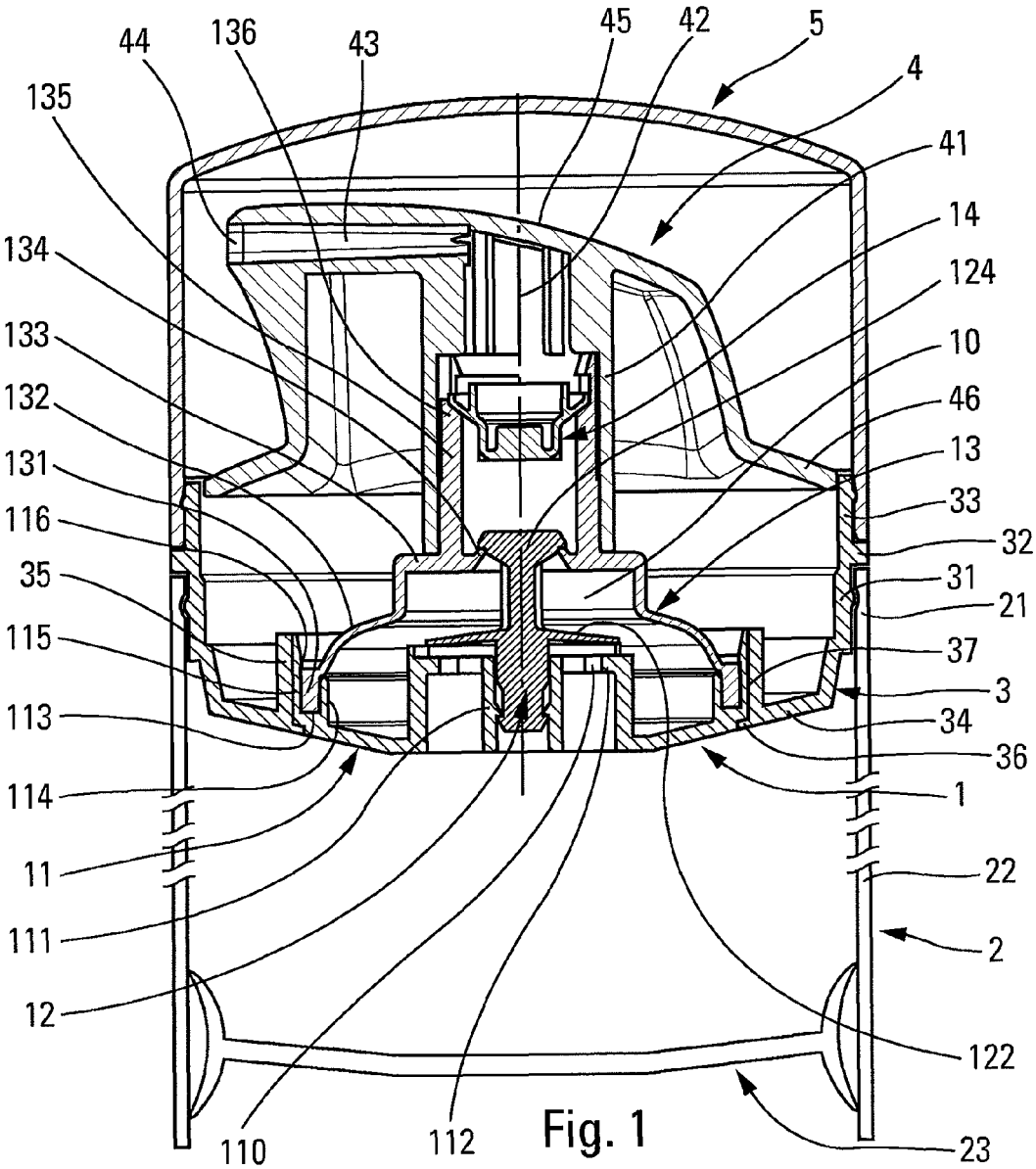
FIG. 1 is a vertical section view through a fluid dispenser constituting an embodiment of the invention.

In FIG. 1, the pump 1 is associated with an adapter dish 3, a reservoir 2, a pusher 4, and a cap 5 in order to form a fluid dispenser. The cap 5 is optional.

In the non-limiting embodiment in FIG. 1, the reservoir 2 is a variable-volume reservoir. More particularly, the reservoir 2 comprises a substantially-cylindrical cylinder 22 inside which a follower piston 23 is slidably mounted in leaktight manner. Initially, the follower piston 23 is situated in the proximity of the open bottom of the cylinder 22. In this configuration, the reservoir defines a maximum working volume 20 that decreases as the follower piston 23 rises inside the cylinder 22. The reservoir also defines a neck 21 that, in this embodiment, extends upwards in register with the cylinder 22. The neck 21 presents means that enable the dish 3 to be fastened in stable and leaktight manner on the reservoir. In this embodiment, the neck 21 internally defines one or more fastener profiles in the form of grooves and/or ribs.

The adapter dish 3 is a mounting part that enables the pump 1 to be mounted in stationary manner on the reservoir 2. The pump 1 is not mounted directly onto the reservoir 2, although this is entirely possible. In that event, the dispenser would not include an adapter dish, since the reservoir itself would constitute the mounting part on which the pump is mounted. However, in the FIG. 1 embodiment, the pump 1 is mounted on the adapter dish 3 that is itself mounted on the reservoir 2. More precisely, the dish 3 includes a fastener section that is engaged inside the neck 21. The fastener section 31 can be formed with one or more fastener profiles that are complementary to those of the neck 21. Above the section 31, the dish 3 forms a peripheral flange 32 that projects radially outwards and that is for coming to bear against the top edge of the neck 21. Beyond the flange 32, the dish forms a rim 33 for removably snap-fastening the cap 5 that can come to bear against the flange 32. The dish 3 extends downwards from the fastener section 31 so as to form a substantially-radial section 34 that is extended inwards by a mounting ring 35 that is substantially cylindrical. The ring 35 is upwardly open and is closed a little towards the bottom by a peripheral shoulder 36 that projects substantially radially inwards. The shoulder 36 can extend in register with the flange 34. Thus, the ring and the shoulder 36 co-operate with each other to form a mounting housing 37 that is axially accessible from above. When the dish 3 is mounted on the reservoir 2, the major fraction of the dish is situated inside the reservoir 2, with only the peripheral flange 32 and the rim 33 projecting out from the reservoir.

In this embodiment, the pump 1 comprises four main component elements, namely: a body 11; an inlet valve member 12; a flexible part 13; and an outlet-valve movable member 14. Naturally, the pump could comprise fewer parts, or, on the contrary, could comprise more parts, without thereby going beyond the ambit of the invention.

The body 11 of the pump is the part that serves to support other component elements of the pump, such as the flexible part 13 and the valve member 12. The body 11 is also the part that is mounted directly on the adapter dish 3 in its mounting housing 37. More precisely, the body 11 is inserted into the ring 35 until it comes into abutment against the shoulder 36.

The body 11 defines a fluid inlet 110 that, in this embodiment, is in the form of a plurality of inlet holes. Over the periphery of the holes, the body defines an inlet-valve seat 112. The seat 112 is for co-operating with a movable inlet-valve member 122 that is formed by the inlet-valve element 12. The movable member 122 can be in the form of a disk or a washer that is axially movable or deformable. In order to hold the valve element 12 in place, the body 11 forms a central chimney 111 in which the inlet valve element 12 is held captive. However, it can move over a small stroke enabling the movable member 122 to move relative to its seat 112. Over its outer periphery, the body 11 forms a housing 113 for holding and fastening an anchor heel 131, as described below. The housing 113 comprises a stationary inside wall 114 and a movable outside wall or portion 115. Moving the movable portion 115 radially inwards enables the housing 113 to close in on itself. In this embodiment, the movable portion 115 is formed by an outer peripheral collar that surrounds the stationary inside wall 114 in coaxial manner. The housing 113 is thus defined by an annular gap that is defined between the inside wall 114 and the deformable outer peripheral collar 115.

Figure 2:
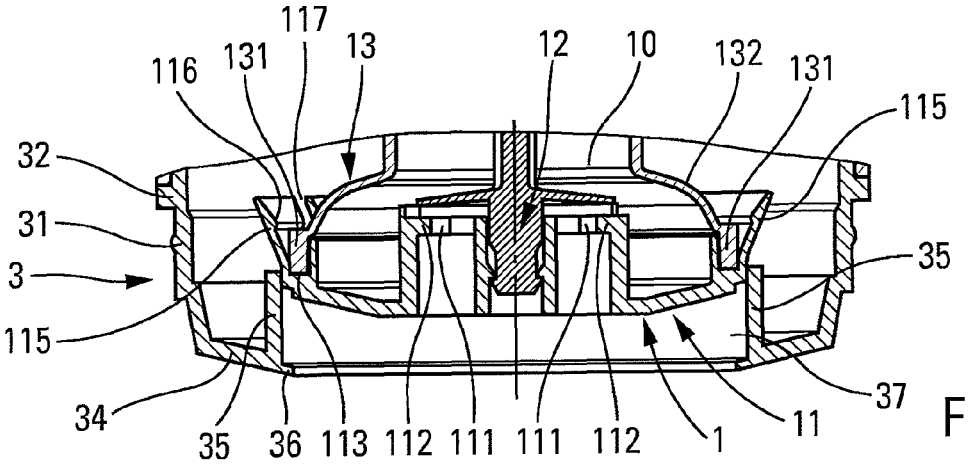
FIG. 2 is a fragmentary section view of the FIG. 1 dispenser member just before it is mounted on the adapter dish.

In the invention, it is the engagement of the body 11 in the mounting housing 37 that enables the collar 115 to be deformed inwards so as to close the housing 113. With reference to FIG. 2, it can be seen that, before being mounted inside the ring 35, the collar 115 flares outwards and upwards. Its maximum outside diameter is greater than the inside diameter of the ring 35. As a result, by engaging the collar 115 in the ring 35, the collar 115 is constrained to deform radially inwards, closing the housing 113 in on itself, thereby holding the anchor heel 131 permanently captive. The collar 115 can be continuous over its periphery, or in a variant, as shown in FIG. 2, the collar can be interrupted by slots 117 that thus divide the collar into a plurality of tabs or tongues. Regardless of whether the collar is continuous or slotted, it can be provided internally with a projecting bead 116 that enables the housing 113 to be closed more firmly. The bead 16 becomes engaged just above the top edge of the anchor heel 131. From FIG. 2, it can easily be understood that the collar 115 progressively deforms radially inwards against the anchor heel 131 as the pump 1 is inserted into the ring 35. Finally, the bottom end of the collar 115 comes into abutment against the shoulder 36, as shown in FIG. 1. It can thus be said that the pump 1, as shown in part in FIG. 2, is in an initial pre-mounted or pre-assembled configuration in which, although the anchor heel 131 is indeed inserted in the housing 113, the housing 113 is not yet in its final mounted configuration. It is only after mounting the pump in the adapter dish 3 that the housing reaches its final mounted configuration.

In this embodiment, the ring 35 is cylindrical, but it is possible to imagine other configurations for the ring, e.g. frustoconical or profiled.

The flexible part 13 is preferably made as a single part from a plastics material that is relatively flexible, when it presents wall thicknesses that are small. The flexible part 13 thus comprises: an anchor heel 131 that is engaged in the housing 113; an elastically-deformable membrane 132; a rigid plate 133 that internally defines a closure seat 134; and a rigid bushing 135 that, at its top end, defines an outlet-valve seat 136. The elastically-deformable membrane 132 co-operates with the body 1 to define a pump chamber 10 of volume that varies by deforming the membrane. The membrane 132 thus serves both as a piston and as a return spring. It is its shape memory that enable it to return elastically to its initial rest configuration. In the rest configuration as shown in FIG. 1, the seat 134 of the plate 133 is engaged with a closure element 124 that is formed integrally with the inlet-valve member 12. It should also be observed that the closure element 124, engaged on its seat 134, lifts the movable member 122 of the inlet valve off its seat 112. Thus, in the rest position, the inlet valve is open and communicates with the reservoir 2. In contrast, the chamber 10 is closed at the closure element 124 that bears against its seat 134. This position exists only while the flexible membrane 132 is at rest. In contrast, once the flexible membrane is deformed, the movable member 122 comes to press against its seat 112 and the closure element 124 lifts off its seat 134. The chamber 10 is thus isolated from the reservoir 2 by the closed inlet valve, but can communicate upwards with the inside of the rigid bushing 134. The fluid that is forced out of the chamber 10 thus comes into contact with the movable member 14 of the outlet valve that is adapted to come into leaktight contact against its seat 136 formed at the top end of the rigid bushing 135. As a result of its pressure, the fluid lifts the movable member 14, thereby creating a flow passage.

In conventional manner, the pusher 4 comprises: a connection sleeve 41; an outlet channel 43; a dispenser orifice 44; and a thrust surface 45. The connection sleeve 41 is engaged in stationary manner around the rigid bushing 134. The sleeve 41 internally defines a duct 42 that communicates with the outlet channel 43 that opens out to the outside at the dispenser orifice 44. The bearing surface 45 enables the user to press one or more fingers axially on the pusher, so as to deform the elastically-deformable membrane 132. Fluid is thus dispensed at the dispenser orifice 44. The pusher 4 can also define an outer peripheral skirt 46 that can move inside the adapter dish 3.

Mounting the pump in the adapter dish 3 thus makes it possible to hold the anchor heel 131 in the housing 113 in stationary and leaktight manner. However, in the context of the present invention, it is possible to imagine that mounting the pump in the dish has an influence on some other element of the pump so as to generate or improve any technical effect.

In FIG. 2, it can be seen that the pump is engaged in the housing 37 of the adapter dish from above. Without going beyond the ambit of the present invention, it is also possible to engage the pump in the housing of the dish from below. This would require a small modification to the housing, namely replacing the shoulder 36 with an insertion cone so as to enable the collar to be engaged in the housing. A final snap-fastening could be provided.

Although the present invention is described with reference to a pump including an elastically-deformable membrane, the teaching of the present invention can be applied to any type of pump, or more generally to any type of fluid dispenser member. In addition, the adapter dish 3 that constitutes a mounting part can very well be omitted, such that the pump 1 is mounted directly in the reservoir 2.

The invention claimed is:

1. A fluid dispenser member for associating with a fluid reservoir so as to form a fluid dispenser, said member including a body via which the dispenser member is mounted in stationary manner on a mounting part, the body defining a housing for receiving another component element of the dispenser member, the housing includes a movable portion that is displaceable from an initial configuration in which the housing is open, to a final configuration in which the housing is closed on the component element while the dispenser member is being mounted in the mounting part.

2. A dispenser member according to claim 1, in which the movable portion of the housing comprises an outer peripheral collar that is deformable radially inwards against said component element so as to block the component element firmly in the housing.

3. A dispenser member according to claim 2, in which the collar is continuous over a periphery of the collar.

4. A dispenser member according to claim 2, in which the collar is slotted over a periphery of the collar.

5. A dispenser member according to claim 1, in which said component element co-operates with the body to form a fluid dispenser chamber.

6. A dispenser member according to claim 5, in which said component element forms an elastically-deformable membrane that is provided with an anchor heel that is engaged in leaktight manner in the housing, the movement of the movable portion compressing the heel in the housing.

7. A fluid dispenser comprising the fluid dispenser member according to claim 1, and the fluid reservoir.

8. A fluid dispenser according to claim 7, in which the mounting part is the reservoir.

9. A fluid dispenser according to claim 7, in which the mounting part is an adapter dish that is received on the reservoir, the dish including a ring in which the body of the dispenser member is mounted, the movable portion being moved into the final configuration while the movable portion is being engaged in the ring.

10. A fluid dispenser according to claim 7, in which the reservoir comprises a cylinder and a follower piston that is engaged to slide in the cylinder in sealed manner, and the dispenser member is an airless pump.

11. The fluid dispenser according to claim 1, wherein the mounting part displaces the movable portion from the initial configuration to the final configuration.

12. The fluid dispenser according to claim 1, wherein the mounting part displaces the movable portion from the initial configuration to the final configuration by compressing the movable portion radially inward as the body and the component element are axially brought together in a final assembled position.

* * * * *